US006445170B1

(12) United States Patent
Pangal et al.

(10) Patent No.: US 6,445,170 B1
(45) Date of Patent: Sep. 3, 2002

(54) CURRENT SOURCE WITH INTERNAL VARIABLE RESISTANCE AND CONTROL LOOP FOR REDUCED PROCESS SENSITIVITY

(75) Inventors: Amaresh Pangal, Hillsboro; Siva G. Narendra, Beaverton; Aaron K. Martin, Hillsboro; Stephen R. Mooney, Beaverton, all of OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/694,901

(22) Filed: Oct. 24, 2000

(51) Int. Cl.[7] ..... G05F 1/56
(52) U.S. Cl. ..... 323/315; 323/317
(58) Field of Search ..... 323/312, 315, 323/317, 298, 311

(56) References Cited

U.S. PATENT DOCUMENTS

| | | | | |
|---|---|---|---|---|
| 4,475,077 A | * | 10/1984 | Nagano | 323/312 |
| 4,573,168 A | | 2/1986 | Henze et al. | 375/36 |
| 4,624,006 A | | 11/1986 | Rempfer et al. | 377/69 |
| 4,967,140 A | * | 10/1990 | Groeneveld et al. | 323/315 |
| 5,218,239 A | | 6/1993 | Boomer | 307/443 |
| 5,253,249 A | | 10/1993 | Fitzgerald et al. | 370/24 |
| 5,457,406 A | | 10/1995 | Takada et al. | 326/30 |
| 5,490,171 A | | 2/1996 | Epley et al. | 375/257 |
| 5,604,450 A | | 2/1997 | Borkar et al. | 326/82 |
| 5,783,936 A | * | 7/1998 | Girard et al. | 323/315 |
| 5,793,248 A | | 8/1998 | Lee et al. | 327/543 |
| 5,841,827 A | | 11/1998 | Chevallier | 377/20 |
| 6,037,811 A | | 3/2000 | Ozguc | 327/108 |
| 6,087,847 A | | 7/2000 | Mooney et al. | 326/30 |
| 6,121,764 A | * | 9/2000 | Stockstad | 323/315 |
| 6,133,749 A | | 10/2000 | Hansen et al. | 326/30 |
| 6,150,806 A | * | 11/2000 | Canard et al. | 307/296.1 |
| 6,188,237 B1 | | 2/2001 | Suzuki et al. | 326/30 |

OTHER PUBLICATIONS

Filanovsky , I.M., "Voltage Reference Using Mutual Compensation of Mobility and Threshold Voltage Temperature Effects", *ISCAS 2000–IEEE International Symposium on Circuits and Systems*, V197–V200, (May 28–31, 2000).

Haycock, M., et al., "A 2.5Gb/s Bidirectional Signaling Technology", *Hot Interconnects Symposium V*, 1–8, (Aug. 21–23, 1997).

Layton, K., et al., "A CMOS Voltage to Current Converter for Low–Voltage Applications", *AMI Engineering Forum, American Microsystems Inc.*, http://www.ee.byu.edu/faculty/comerdt/publications.html http://www.ee.byu.edu/faculty/comerdj/publications.html, 13 pages, (Oct. 1999).

Lee, S., et al., "A Temperature and Supply–Voltage Insensitive CMOS Current Reference", *IEICE Trans. Electron*, vol. E82–C ,1562–1566, (Aug. 1999).

* cited by examiner

*Primary Examiner*—Adolf Deneke Berhane
(74) *Attorney, Agent, or Firm*—Schwegman, Lundberg, Woessner & Kluth P.A.

(57) ABSTRACT

A current reference with reduced sensitivity to process variations includes two current sources. The first current source has an output current that is sensitive to process variations. The second current source has, as a component of its input current, the output current of the first current source. The input current to the second current source is substantially constant because the process dependent component has been removed by the output current of the first current source. Variable resistors internal to the current source are set using a control loop circuit and an external resistor.

30 Claims, 5 Drawing Sheets

CURRENT SOURCE WITH INTERNAL VARIABLE RESISTANCE AND CONTROL LOOP FOR REDUCED PROCESS SENSITIVITY

FIELD

The present invention relates generally to current references, and more specifically to current references that provide substantially constant current.

BACKGROUND

Current references are circuits that are designed to provide constant current. The constant current is utilized in other circuits, and the design of these other circuits typically relies on the current being constant. One problem with current references is that the current provided can be sensitive to voltage, temperature, and process variations. That is to say, as the voltage, temperature, or process parameters (such as transistor threshold voltages) vary, the current generated by the current reference also varies.

Sensitivity to temperature and power supply voltage variations in current references, and the reduction thereof, has been the subject of much study. See, for example, Sueng-Hoon Lee and Yong Jee, "A Temperature and Supply-Voltage Insensitive CMOS Current Reference," IEICE Trans. Electron., Vol.E82-C, No.8 August 1999.

Sensitivity to process variations has been historically handled by design margins. For example, if, over expected process variations, a current generated by a current reference can vary by a factor of two, the current reference is typically designed to have a nominal current equal to twice the minimum specified value so that under worst case conditions, the minimum current value is guaranteed to exist. Power is wasted as a result, in part because the nominal current value is twice what is needed.

For the reasons stated above, and for other reasons stated below which will become apparent to those skilled in the art upon reading and understanding the present specification, there is a need in the art for a current reference with reduced sensitivity to process variations.

DESCRIPTION OF THE EMBODIMENTS

Figure 1:
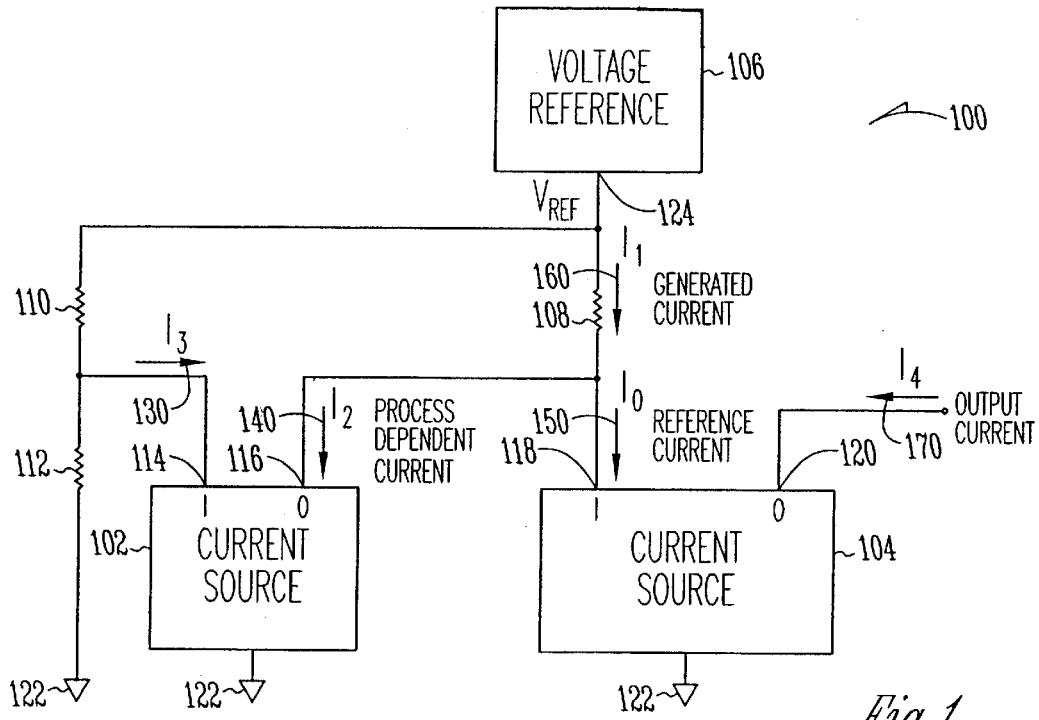
FIG. 1 shows a current reference.

In the following detailed description of the embodiments, reference is made to the accompanying drawings which show, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention. Moreover, it is to be understood that the various embodiments of the invention, although different, are not necessarily mutually exclusive. For example, a particular feature, structure, or characteristic described in one embodiment may be included within other embodiments. The following detailed description is, therefore, not to be taken in a limiting sense, and the scope of the present invention is defined only by the appended claims, along with the full scope of equivalents to which such claims are entitled.

The method and apparatus of the present invention provide a mechanism to reduce a current reference's sensitivity to process variations. A voltage reference provides current to two current sources. The first current source has an output current that is sensitive to process variations. The second current source has, as a component of its input current, the output current of the first current source. The input current to the second current source is substantially constant because the process dependent component has been removed by the output current of the first current source. As a result, the output current of the second current source, which is the output current of the current reference, has reduced sensitivity to process variations.

FIG. 1 shows a current reference. Current reference 100 includes current sources 102 and 104, voltage reference 106, and resistors 108, 110, and 112. For ease of explanation, resistors 108, 110, and 112 are shown as fixed value resistors in FIG. 1. In some embodiments, resistors 108, 110, and 112 are not fixed, but are variable. Some of these embodiments are explained in further detail with reference to figures other than FIG. 1.

Current sources 102 and 104 each have an input node and an output node. For example, current source 104 includes input node 118 and output node 120. The output current 170 of current source 104 is on output node 120, and the input current 150 of current source 104 is on input node 118. Also for example, current source 102 includes input node 114 and output node 116. The output current 140 of current source 102 is on output node 116, and the input current 130 of current source 102 is on input node 114.

In some embodiments, current sources 102 and 104 are current mirrors that each have an output current substantially equal to the input current. For example, output current 170 is substantially equal to input current 150, and output current 140 is substantially equal to input current 130. Throughout this description, input current 130 is also referred to as "$I_3$," and output current 140 is also referred to as "$I_2$" or the "process dependent current." Further, throughout this description, input current 150 is also referred to as "$I_0$," or the "reference current," and output current 170 is also referred to as "$I_4$," or the "current reference output current," which is substantially process independent.

Voltage reference 106 provides a substantially constant reference voltage (labeled "$V_{REF}$" in FIG. 1) at node 124. Voltage reference 106 is coupled to input node 114 of current source 102 through a voltage divider that includes resistors 110 and 112. Voltage reference 106 is coupled to output node 116 of current source 102 and input node 118 of current source 104 through series resistor 108. Current 160 is the current that flows through resistor 108. Throughout this description, current 160 is also referred to as "$I_1$," or the "generated current."

In operation, current source 104 has a substantially constant, and process independent, input current 150, and a substantially constant, process independent, output current 170. As used herein, the term "process independent" is used to describes a substantial lack of sensitivity to process variations. For example, when a current is process independent, the current lacks sensitivity to process variations, and does not substantially change as a function of process variations. Conversely, the term "process dependent" is used to describe a sensitivity to process variations. For example, when a current is process dependent, the current may change as a function of process variations.

Internal process variations within current sources 102 and 104 cause the voltage to be different on the input nodes of different devices. For example, in some manufactured devices, the voltage between input node 114 and reference node 122 may be lower than in others. Also for example, in some manufactured devices, the voltage between input node 118 and reference node 122 may be lower than in others. When the voltage on input node 118 is lower, current 160 is higher, because with a substantially constant reference voltage on node 124, the voltage drop across resistor 108 is greater. In this example, the generated current is higher because the voltage on the input node to current source 104 is lower.

If all of the generated current were to enter input node 118 of current source 104 as the reference current, then the current reference output current would be larger. In various embodiments of the present invention, the increased generated current resulting from a drop in voltage at input node 118 is substantially equal to increase in the process dependent current 140, which is the output current of current source 116. When the voltage on input node 118 takes on different values as a result of process variations, the increase in generated current is compensated for by an increase in process dependent current, and the output current 170 remains substantially constant.

The process dependent current on node 116 is sensitive to process variations. When the voltage on node 114 takes on different values as a result of process variations, current 130 also varies. Current 140 tracks the changes in current 130, and the design of current sources 102 and 104 is such that the process dependent current on node 116 tracks the changes in the generated current 160 so that the reference current 150 remains substantially constant.

Many embodiments of current reference 100 exist. In some embodiments, current sources 102 and 104 are implemented as bipolar transistor current mirrors. In other embodiments, current sources 102 and 104 are implemented using junction field effect transistors (JFETs). In yet other embodiments, current sources 102 and 104 are implemented using metal oxide semiconductor field effect transistors (MOSFETs). Current sources 102 and 104 can be implemented in many other ways without departing from the scope of the present invention.

Figure 2:
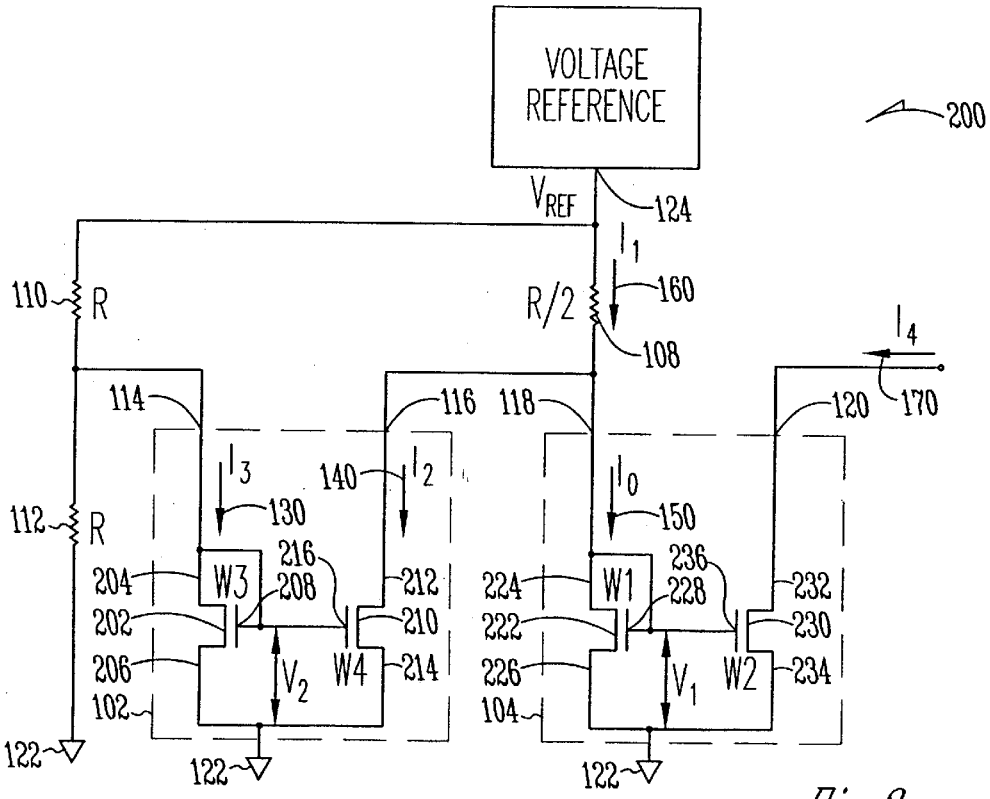
FIG. 2 shows a more detailed diagram of a current reference.

FIG. 2 shows a more detailed diagram of a current reference. Current reference 200 illustrates embodiments having current sources 102 and 104 implemented as MOSFET current mirrors. Current mirror 102 includes N-channel MOSFETs (also referred to as an "NFETs") 202 and 210. NFET 202 includes drain 204, gate 208, and source 206. NFET 210 includes drain 212, gate 216, and source 214. Gates 208 and 216 are coupled together, and are both coupled to input node 114. Sources 206 and 214 are coupled together, and are both coupled to reference node 122. NFET 208 is of size "W3," and NFET 216 is of size "W4." The input current 130 flows through NFET 202 from drain 204 to source 206, and the output current 140 flows through NFET 210 from drain 212 to source 214.

The gate-to-source voltage is one device parameter that varies over process. For example, $V_2$, which is the gate-to-source voltage for both NFETs 202 and 210, may be smaller in some devices than in others due to process variations during manufacture. When $V_2$ is smaller, then the voltage on input node 114 is smaller, and more current exists on input node 114. The current on node 116 closely matches the current on node 114 (assuming W3 and W4 are equal), and is, therefore, process-dependent.

Current source 104 includes NFETs 222 and 230. NFET 222 includes drain 224, gate 228, and source 226. NFET 230 includes drain 232, gate 236, and source 234. NFETs 222 and 230 in current source 104 are interconnected in a similar manner as NFETs 202 and 210 in current source 102. NFET 222 has a size "W1," and NFET 230 has a size "W2." Reference current 150 flows through NFET 222 from drain 224 to source 226, and output current 170 flows through NFET 230 from drain 232 to source 234.

The gate-to-source voltage of NFETs 222 and 230 is shown as $V_1$. $V_1$ varies over process in the same manner as $V_2$. In the example above, where $V_2$ is lower and the process dependent current on output node 116 is higher, $V_1$ is also lower, causing the generated current 160 to be higher. When the change in the process dependent current is substantially equal to the change in the generated current, then the reference current 150 is substantially constant. As a result, the current reference output current is also substantially constant.

This behavior is now described mathematically. The current reference output current is equal to the reference current multiplied by the ratio of the sizes of NFETs 230 and 222, $$I_4 = I_0(W2/W1) \tag{1}$$

and the reference current is equal to the generated current minus the process dependent current.

$$I_0 = I_1 - I_2 \tag{2}$$

The generated current is equal to the voltage across the series resistor divided by the value of the series resistor, $$I_1 = \frac{V_{REF} - V_1}{R/2} \tag{3}$$

and the process independent current is equal to the input current of current source 102 multiplied by the ratio of the sizes of NFETs 210 and 202.

$$I_2 = I_3(W4/W3) \tag{4}$$

The input current to current source 102 is equal to the current through resistor 110 minus the current through resistor 112.

$$I_3 = \frac{V_{REF} - V_2}{R} - \frac{V_2}{R} \tag{5}$$

Substituting equations (2), (3), (4), and (5) into equation (1) yields $$I_4 = \left(\frac{V_{REF} - V_1 - (V_{REF}/2 - V_2)(W4/W3)}{R/2}\right)(W2/W1) \tag{6}$$

Assuming W4=W3, W2=W1, and $V_1 = V_2$, equation (6) becomes $$I_4 = \frac{V_{REF}}{R} \tag{7}$$

As shown in equation (7), the current reference output current is equal to the voltage of the voltage reference divided by the resistance R. As long as the voltage and resistance are substantially constant, then the current reference output current is also substantially constant. The voltage $V_{REF}$ can be kept substantially constant using known methods. One known method is shown in I. M. Filanovsky, "Voltage Reference Using Mutual Compensation of Mobility and Threshold Voltage Temperature Effects," 197–200, ISCAS 2000, May 28–31, 2000, Geneva, Switzerland.

As mentioned with reference to FIG. 1, in some embodiments, resistors 108, 110, and 112 are variable resistors. Example embodiments with variable resistors are shown in the following figures, and described with reference thereto.

Figure 3:
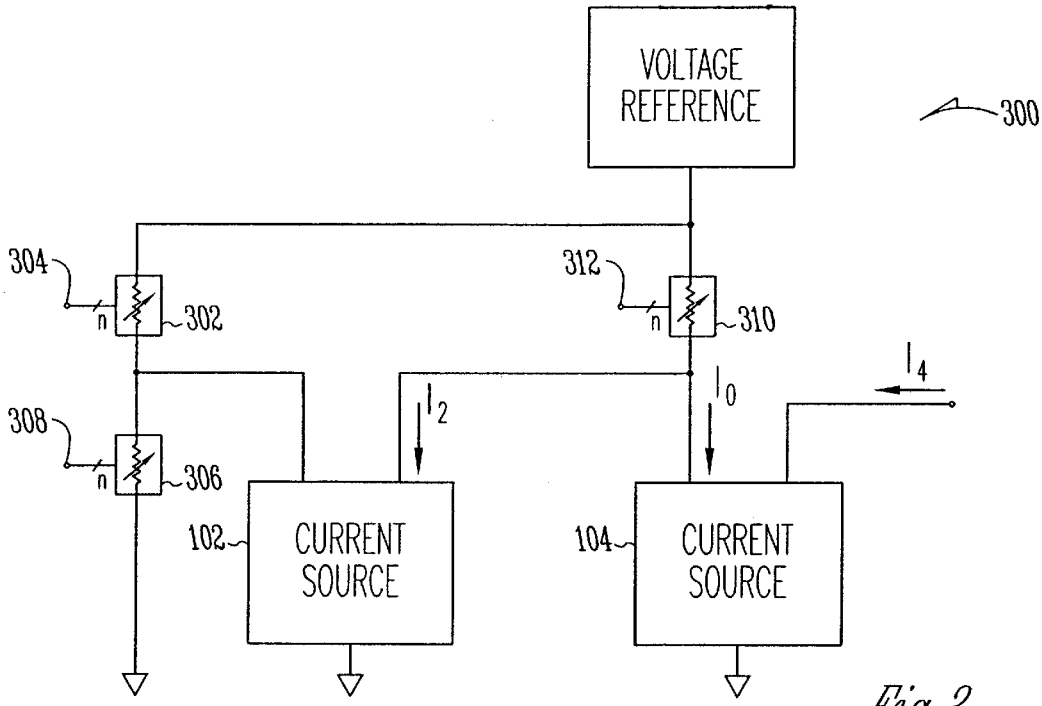
FIG. 3 shows a current reference with variable resistors.

FIG. 3 shows a current reference with variable resistors. Current reference 300 includes the same components as current reference 100 (FIG. 1), with the exception of variable resistors 310, 302, and 306. Variable resistors 310, 302, and 306 correspond to resistors 108, 110, and 112, respectively, in FIG. 1. As described with reference to FIG. 2, when the resistance values are process independent, the current reference output current can be maintained substantially constant.

Each of resistors 310, 302, and 306 are variable resistors with resistance values that change responsive to signals on a control input bus. For example, resistor 310 includes control signals on control input bus 312. A number "n" of control signals are represented in FIG. 3, however, any number of control signals can be utilized. The resistance value of resistors 310, 302, and 306 are modified by changing signal values present on the respective control input bus. Example implementation embodiments of the variable resistors and the control of their resistance values are explained in more detail with reference to the figures that follow.

Figure 4:
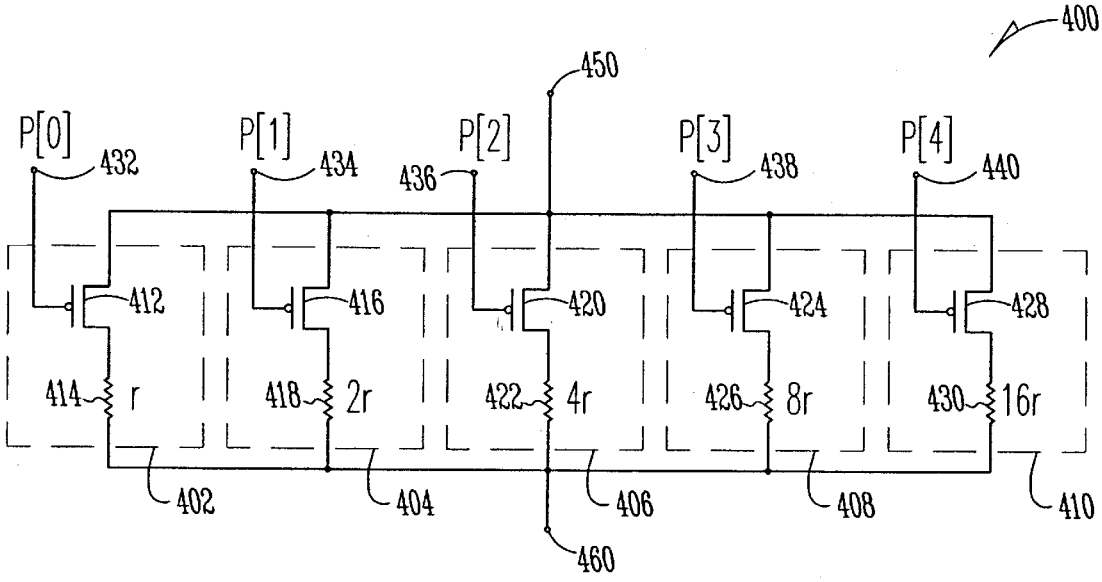
FIG. 4 shows a first variable resistor.

FIG. 4 shows a first variable resistor. Variable resistor 400 includes multiple resistive devices, each having a control input node. For example, variable resistor 400 includes resistive devices 402, 404, 406, 408, and 410. Each of the resistive devices includes a transistor and a fixed value resistor. For example, resistive device 402 includes PFET 412 and resistor 414. Likewise, resistive devices 404, 406, 408, and 410 include PFETs 416, 420, 424, and 428 and resistors 418, 422, 426, and 430, respectively.

Each resistive device is coupled in parallel between two reference nodes 450 and 460. Each resistive device includes a control input node having a signal that either turns on or turns off the PFET. For example, PFET 412 within resistive device 402 has a gate driven with the signal on control node 432. Likewise, control nodes 434, 436, 438, and 440 provide control signals to PFETs 416, 420, 424, and 428, respectively.

The resistors within the resistive devices can be any type of resistor fabricated on an integrated circuit. In some embodiments, resistors are fabricated as N-well resistors, as is known in the art. In the embodiment shown in FIG. 4, the resistive devices have binary weighted resistance values. For example, resistor 414 has a resistance value of "r," and resistor 414 has a resistance value of "2r." The resistance values double for each resistive device, and the largest resistance value of "16r" exists in resistance element 410.

Control input nodes 432, 434, 436, 438, and 440, taken together, form a control bus. In the embodiment of FIG. 4, this control bus is driven by a five bit wide signal labeled P[4:0]. The generation of this five bit wide signal is explained further with reference to later figures. By varying which control signals are asserted, 31 different resistance values can be obtained between nodes 450 and 460.

Variable resistor 400 utilizes P-channel transistors, and is useful to implement resistors with voltages closer to a positive voltage reference than to a negative voltage reference. For example, variable resistor 400 can be utilized for variable resistors 302 and 310 (FIG. 3). When variable resistor 400 is utilized for variable resistor 310, the five bit wide control bus of FIG. 4 corresponds to control input bus 312. Referring now back to FIG. 2, resistor 110 has a value of R, while resistor 108 has a value of R/2. Embodiments of variable resistor 400 can be utilized to implement both resistors 108 and 110 by adjusting the resistor values of each resistance element within variable resistor 400 for each embodiment.

Figure 5:
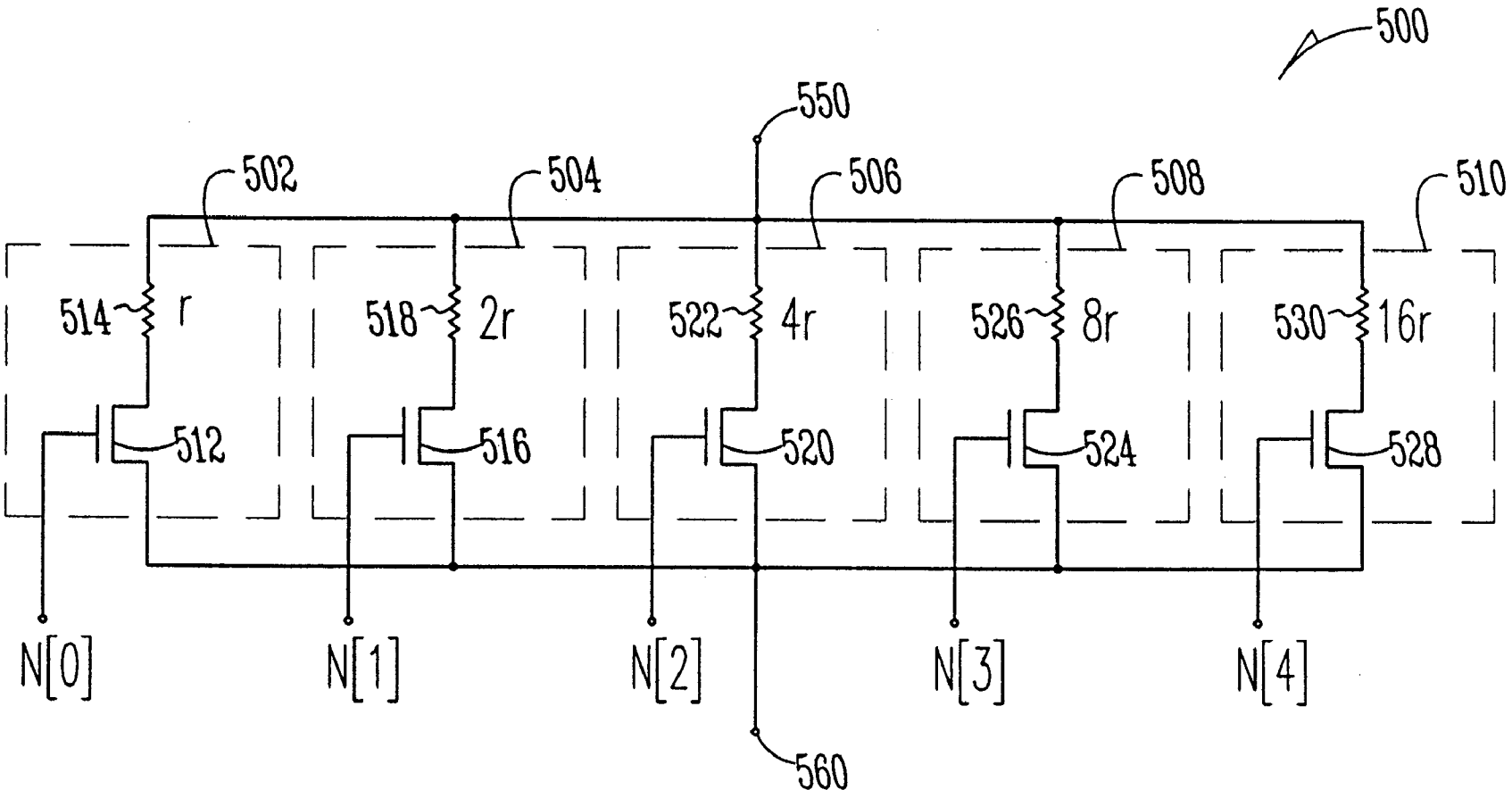
FIG. 5 shows a second variable resistor.

FIG. 5 shows a second variable resistor. Variable resistor 500 includes resistive devices analogous to those shown in FIG. 4. Resistive devices 502, 504, 506, 508, and 510 include binary weighted fixed value resistors 514, 518, 522, 526, and 530, respectively. The same resistive devices include N-channel transistors 512, 516, 520, 524, and 528, respectively. Each of the N-channel transistors have a control input node driven by one signal from a 5 bit wide bus labeled N[4:0]. As the signals on the five bit wide bus vary, some resistive devices are included in the circuit, and some resistive devices are removed from circuit. A combination of resistive devices that are on in parallel sum to create a total resistance value between nodes 550 and 560. Thirty-one different values of resistance can be generated by variable resistor 500.

Variable resistor 500 includes N-channel transistors, and is useful when operating at low voltages. For example, variable resistor 500 can be utilized to implement variable resistor 306 (FIG. 3). When used to implement variable resistor 306, the five bit wide control bus of variable resistor 500 corresponds to control input bus 308.

Variable resistors 400 (FIG. 4) and 500 have been described with resistive devices, each including a resistor with a binary weighting relative to the other resistors. Any number of resistive devices can be included without departing from the scope of the present invention. Binary weighting can be maintained with a large number of resistive devices, or a linear weighting can be employed. For example, variable resistor 500 can be implemented with each resistive device including a resistor of equal value. This reduces the number of possible resistance values available, but also reduces the possibility of a transient resistance value appearing when signal values on the input bus change.

Figure 6:
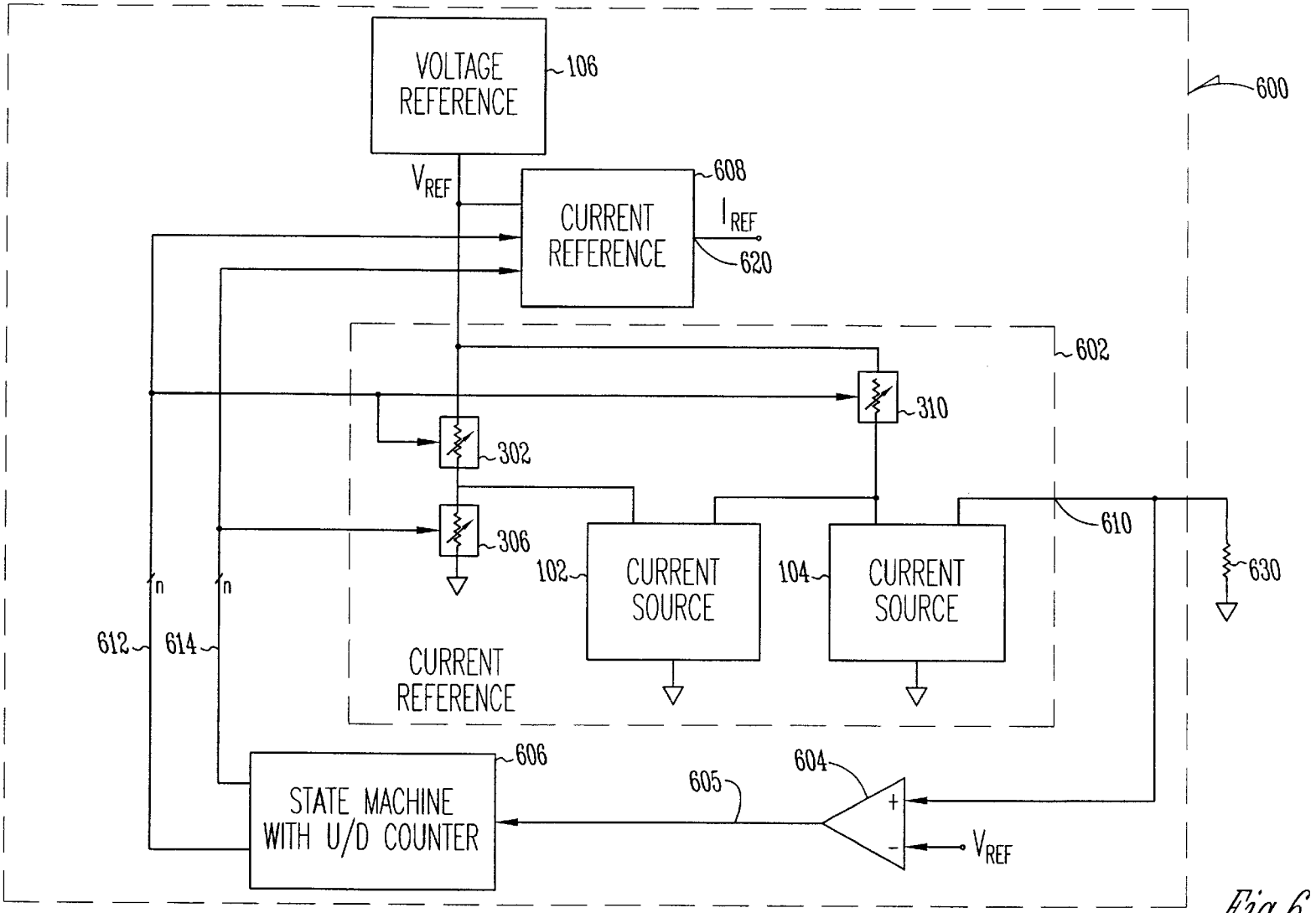
FIG. 6 shows an integrated circuit having a current reference and a control loop circuit.

FIG. 6 shows an integrated circuit having a current reference and a control loop circuit. Integrated circuit 600 includes two current references 602 and 608, voltage reference 106, voltage comparator 604, and state machine 606. Current reference 602 is shown as current reference 300 (FIG. 3) with voltage reference 106 being shared between current references 602 and 608. Each of variable resistors 302, 310, and 306 within current reference 602 are driven by control signals generated by state machine 606 on nodes 612 and 614. Current reference 602, voltage comparator 604, and state machine 606 form a control loop circuit that modifies the resistance values of variable resistors 302, 306, and 310. Also shown in FIG. 6 is resistor 630, which is external to integrated circuit 600. High precision resistors are readily available, and resistor 630 can be a high precision resistor selected for a particular application of integrated circuit 600.

Current source 602 generates an output current on node 610 as described with reference to the previous figures. This current travels through precision resistor 630 and generates a voltage. This voltage is compared against the reference voltage by voltage comparator 604. In some embodiments, voltage comparator 604 produces a digital output on nodes 605, which is input to state machine 606. In some embodiments, state machine 606 includes a counter that counts up or down depending on the value of the digital signal on nodes 605. As state machine 606 counts up or down, control signals on nodes 612 and 614 modify resistance values of variable resistors 304, 302, and 306. As a result of the change in resistance values, current reference 602 modifies the current on output node 610, and the loop is closed.

By utilizing variable resistors 302, 310, and 306, resistance values can be trimmed to match, or to be a function of, the resistance of an external precision resistor. When the control loop circuit is locked and the variable resistors internal to current reference 602 have stable resistance values, the output current on output node 610 satisfies equation (7), above, where "R" is the static value of variable resistors 302 and 306.

Integrated circuit 600 includes two current references 602 and 608. The output current from current reference 602 is utilized to close the control loop that generates control signals on nodes 612 and 614. Current reference 608 receives the control signals on nodes 612 and 614 and produces a current reference output current (shown as "$I_{REF}$" in FIG. 6) on node 620.

Any number of current references can utilize the control signals on nodes 612 and 614. One current reference, current reference 602, is used to close the control loop circuit, but many more current references can utilize control signals generated thereby.

Figure 7:
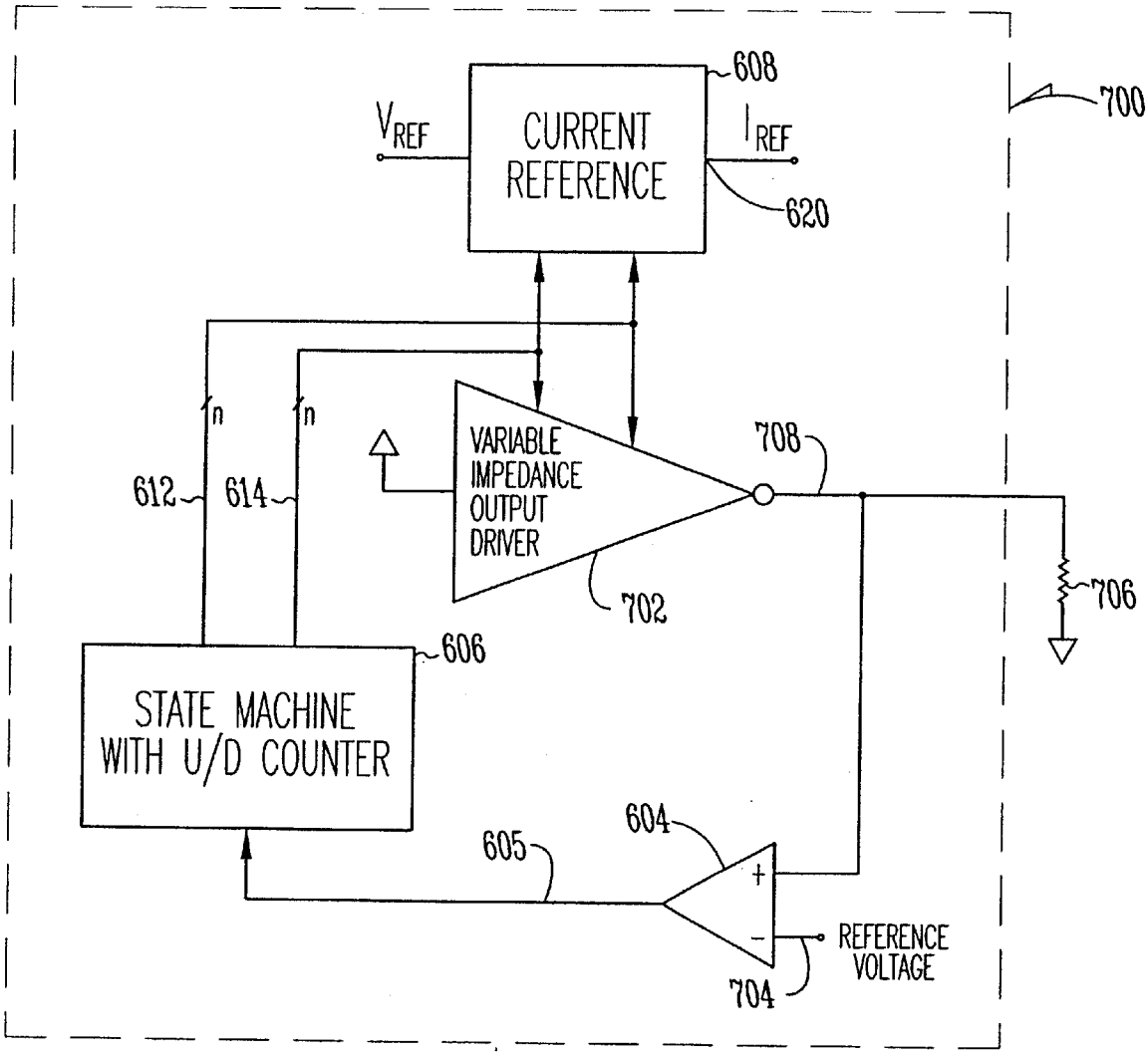
FIG. 7 shows an integrated circuit having a current reference and a variable impedance output driver sharing a common control loop circuit.

FIG. 7 shows an integrated circuit having a current reference and a variable impedance output driver sharing a common control loop circuit. Integrated circuit 700 includes current reference 608, voltage comparator 604, and state machine 606. Integrated circuit 700 also includes variable impedance output driver 702. In the embodiment of FIG. 7, the control loop circuit does not include current reference 608, but instead includes variable impedance output driver 702.

In operation, the output impedance of variable impedance output driver 702 is modified by control signals on nodes 612 and 614. The voltage on node 708 is a function of external resistor 706 and the output impedance of driver 702. Voltage comparator 604 compares the voltage on node 708 with the reference voltage on node 704 and generates a signal on node 605, which is input to state machine 606. When the output impedance of driver 702 is at a proper value, the loop is locked, and signals on nodes 612 and 614 change more slowly, or not at all. Current reference 608 utilizes the control signals on nodes 612 and 614 to modify internal resistances and thereby providing a substantially constant output current on node 620.

An example control loop circuit that includes a variable impedance output driver, voltage comparator, and a state machine, is described in M. Haycock and R. Mooney, "A 2.5 Gb/s Bidirectional Signaling Technology," Hot Interconnect Symposium V, Aug. 21–23, 1997.

Integrated circuit 700 can be any integrated circuit capable of including a current reference such as current reference 100 (FIG. 1) or 200 (FIG. 2). Integrated circuit 700 can be a processor such as a microprocessor, a digital signal processor, a microcontroller, or the like. Integrated circuit 700 can also be an integrated circuit other than a processor such as an application-specific integrated circuit (ASIC), a communications device, a memory controller, or a memory such as a dynamic random access memory (DRAM).

Integrated circuit 700 utilizes a single external resistor in a control loop to set the values of multiple internal components. For example, current reference 608 includes internal variable resistors with resistance values set, and variable impedance output driver 702 has an impedance set. Any number of components internal to integrated circuit can be modified by the control signals generated in the control loop circuit that uses the external resistor. In this manner, a single external resistor can be shared among many internal components.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A current reference comprising:

a first current source having an output node to produce an output current that varies with process variations;

a second current source having an input node to receive an input current, and an output node to produce a current reference output current, the input node being coupled to the output node of the first current source, such that the output current of the first current source influences the current reference output current;

a variable resistor coupled to the input node of the second current source; and a control loop circuit to influence the variable resistor.

2. The current reference of claim 1 wherein the variable resistor comprises a plurality of resistive devices in parallel, each of the plurality of resistive devices having a control input node to enable the resistive device.

3. The current reference of claim 2 wherein the control loop circuit includes output nodes, and wherein the control input node of each resistive device is coupled to one of the output nodes of the control loop circuit.

4. The current reference of claim 2 wherein the control loop circuit comprises:

a comparator to compare two voltages, the comparator having an output node; and a state machine coupled to the output node of the comparator, the state machine having output nodes coupled to the control input nodes of the plurality of resistive devices.

5. The current reference of claim 1 wherein the first current source comprises:

a first NFET device having a gate, a source, and a drain; and a second NFET device having a gate, a source, and a drain;

wherein the gates of the first and second NFET devices are coupled together, the drain and the gate of the first NFET are coupled together, and the drain of the second NFET is coupled to the output node of the first current source such that the first current source output current conducts from the drain to the source of the second NFET device.

6. The current reference of claim 5 wherein the second current source comprises:

a third NFET device having a drain and a gate both coupled to the input node of the second current source such that the input current of the second current source is modified by the output current of the first current source; and a fourth NFET device having a gate coupled to the gate of the third NFET device, and a drain coupled to the output node of the second current source such that the current reference output current conducts from the drain to the source of the fourth NFET device.

7. The current reference of claim 1 further comprising a circuit, coupled to the variable resistor, to produce a generated current, such that the input current is equal to the generated current minus the first current source output current.

8. The current reference of claim 7 wherein the circuit comprises a voltage reference such that the variable resistor is coupled in series between the voltage reference and the input node of the second current source.

9. A current reference comprising:

a first current source having an input node and having an output node to produce an output current that varies with process variations;

a second current source having an input node to receive an input current, and an output node to produce a current reference output current, the input node being coupled to the output node of the first current source, such that the output current of the first current source influences the input current of the second current source;

a voltage divider circuit coupled to the input node of the first current source, the voltage divider circuit including variable resistors; and a control loop circuit to influence the variable resistors.

10. The current reference of claim 9 further comprising a voltage reference and a resistive device coupled to the input node of the second current source to provide a generated current, wherein the generated current is the sum of the output current of the first current source and the input current of the second current source.

11. The current reference of claim 10 wherein the second current source includes a current mirror to produce the current reference output current as a finction of the input current of the second current source.

12. The current reference of claim 10 wherein the first current source and the second current source each comprise two NFET devices connected as current mirrors.

13. The current reference of claim 10 wherein the resistive device coupled to the input node of the second current source comprises a variable resistor having a control input node coupled to an output node of the control loop circuit.

14. The current reference of claim 10 wherein the voltage divider circuit comprises:

a first variable resistor coupled between the voltage reference and the input node of the first current source; and a second variable resistor coupled between the input node of the first current source and a reference potential node.

15. The current reference of claim 14 wherein the first variable resistor includes a first plurality of resistive devices in parallel, each of the first plurality of resistive devices including a PFET and an N-well resistor.

16. The current reference of claim 14 wherein the second variable resistor includes a second plurality of resistive devices in parallel, each of the second plurality of resistive devices including an NFET and an N-well resistor.

17. The current reference of claim 16 wherein the control loop circuit is coupled to a gate of the NFET in each of the second plurality of resistive devices.

18. A current reference comprising:

a voltage reference;

a first current source having an input node coupled to the voltage reference, and having an output node; and a second current source having a second input node and a second output node, wherein the second input node is coupled to the voltage reference and is coupled to the output node of the first current source, such that a current on the output node of the first current source influences an output current on the second output node;

a series resistor coupled between the voltage reference and the second input node; and a control loop circuit to modify a resistance value of the series resistor.

19. The current reference of claim 18 further comprising a voltage divider, wherein the first current source is coupled to the voltage reference through the voltage divider.

20. The current reference of claim 19 wherein the voltage divider includes variable resistors responsive to the control loop circuit.

21. The current reference of claim 19 wherein the series resistor comprises a plurality of variable resistance devices coupled in parallel, each of the plurality of variable resistance devices including a PFET responsive to the control loop circuit.

22. The current reference of claim 19 wherein the voltage divider comprises two resistors of substantially equal resistance, and the series resistor has a resistance value substantially equal to one half of the substantially equal resistance.

23. The current reference of claim 18 wherein the first current source includes two NFETs coupled together as a current mirror such that gate-to-source voltage variations due to process variations vary the output current of the first current source.

24. The current reference of claim 23 wherein the second current source comprises a current mirror with two NFETs having gates coupled together such that current reference output current variations due to process dependent gate-to-source voltage variations due to process variations of the second current source are lessened by variations of the output current of the first current source.

25. An integrated circuit comprising:

a first current source with an input node to receive an input current and an output node to produce an output current that varies with process variations;

a voltage reference to supply a generated current that includes a substantially constant component and a process dependent component, the process dependent component being substantially equal to the output current of the first current source;

a second current source having an input node coupled to both the output node of the first current source and the voltage reference, such that an input current on the input node of the second current source is equal to the substantially constant component;

a variable series resistor coupled between the voltage reference and the input node of the second current source; and a control loop circuit to modify a resistance value of the variable resistor.

26. The integrated circuit of claim 25 further comprising a voltage divider, wherein the first current source comprises a current mirror coupled to the voltage reference through the voltage divider.

27. The integrated circuit of claim 25 wherein the second current source comprises a current mirror coupled to the voltage reference through the variable series resistor.

28. The integrated circuit of claim 27 wherein the voltage divider comprises first and second variable resistance devices responsive to the control loop circuit.

29. The integrated circuit of claim 28 further comprising an output node to drive a resistor external to the integrated circuit, and an input node to sample an external voltage on the external resistor, and wherein the control loop circuit comprises:

a voltage comparator to compare the external voltage and an internal voltage; and a state machine responsive to the voltage comparator to influence the first and second variable resistance devices and the variable series resistor.

30. The integrated circuit of claim 29 further comprising a variable impedance output driver responsive to the control loop circuit.

* * * * *

UNITED STATES PATENT AND TRADEMARK OFFICE

CERTIFICATE OF CORRECTION

PATENT NO. : 6,445,170 B1 
DATED : September 3, 2002
INVENTOR(S) : Amaresh Pangal et al.

It is certified that error appears in the above-identified patent and that said Letters Patent is hereby corrected as shown below:

Title page,
Item [74], *Attorney, Agent, or Firm*, insert -- , -- after "Kluth".

Column 9,
Line 40, delete "finction" and insert -- function --, therefor.

Signed and Sealed this

Eleventh Day of February, 2003

JAMES E. ROGAN
*Director of the United States Patent and Trademark Office*